US005170842A

United States Patent [19]

Kato et al.

[11] Patent Number: 5,170,842

[45] Date of Patent: Dec. 15, 1992

[54] FIN-TUBE TYPE HEAT EXCHANGER

[75] Inventors: Kaoru Kato, Otsu; Hachiro Koma, Kusatsu, both of Japan

[73] Assignee: Matsushita Refrigeration Company, Osaka, Japan

[21] Appl. No.: 381,279

[22] Filed: Jul. 18, 1989

[30] Foreign Application Priority Data

Jul. 22, 1988 [JP] Japan ..... 63-184378

[51] Int. Cl.[5] ..... F28D 1/04

[52] U.S. Cl. ..... 165/151; 165/182

[58] Field of Search ..... 165/151, 182

[56] References Cited

U.S. PATENT DOCUMENTS 4,723,600 2/1988 Yokoyama et al. ..... 165/151
4,832,117 5/1989 Kato et al. ..... 165/151

FOREIGN PATENT DOCUMENTS 0202092 9/1986 Japan ..... 165/151
0259093 11/1986 Japan ..... 165/151
0026494 2/1987 Japan ..... 165/151
0190393 8/1987 Japan ..... 165/151

*Primary Examiner*—John K. Ford
*Attorney, Agent, or Firm*—Wenderoth, Lind & Ponack

[57] ABSTRACT

A fin-tube type heat exchanger includes a large number of plate fins arranged in parallel to each other at predetermined intervals for allowing an air stream to flow between them, and heat exchanging tubes having an outer diameter Do and extending through the plate fins in a direction at right angles thereto. The heat exchanging tubes are set in rows spaced apart by a pitch $L_1$ in a direction parallel to an air stream as represented by $$1.2\ Do \leqq L_1 \leqq 1.8\ Do,$$

and are spaced in each of the rows by a pitch $L_2$ in a direction perpendicular to the air stream as represented by $$2.6\ Do \leqq L_2 \leqq 3.3\ Do.$$

Each of the plate fins is formed, between the heat exchanging tubes, with a plurality of cut and raised portions open to the air stream and protruding alternately is opposite directions from a base plate of the plate fin. The number of cut and raised portions increase from central portions between adjacent heat exchanging tubes in each row towards the leading and trailing edges of the plate fin.

9 Claims, 3 Drawing Sheets

FIN-TUBE TYPE HEAT EXCHANGER

BACKGROUND OF THE INVENTION

The present invention generally relates to a heat exchanger and more particularly, to a fin-tube type heat exchanger to be employed in air conditioning, refrigeration and cold storage units, etc., for facilitating heat transfer between a cooling medium and a fluid such as air or the like.

Conventionally, as shown in FIG. 5, the fin-tube type heat exchanger of the above-described type is constituted by many plate fins 1 arranged in a parallel relation to each other at predetermined intervals, and heat exchanging tubes 3 extending through said plate fins 1 in a direction at right angles thereto. An air stream A is caused to flow between the plate fins 1 for undergoing heat exchange with the cooling medium flowing within the heat exchanging tubes 3. In recent years, although a reduction in size and higher performance have been required for such a fin-tube type heat exchanger, due to the fact that the air velocity between the plate fins is suppressed to reduce noises, etc., the heat resistance offered at the air side is high compared to that offered within the heat exchanging tubes. Therefore, at present, to reduce the difference in heat resistance offered at the air side and within the heat exchanging tubes, the heat transfer area at the air side is enlarged. However, since the expansion of the heat transfer area is limited by physical restraints and economics and by the desirability to save space, etc., a reduction in the heat resistance offered at the air side has been an important characteristic to be achieved in the fin-tube type heat exchanger of this kind.

In FIGS. 6 and 7, there is shown one example of a conventional fin-tube type heat exchanger in which fin collars 2 are erected on a plate fin 1 at equal intervals. Between said fin collars 2, cut and raised portions 1*a* are formed so as to be open to air stream A only at the side of the plate fin 1 from which the fin collars 2 protrude and so as to project from the surface of the base plate of the plate fin 1 by distances equal to each other. The cut and raised portions referred to above are intended to prevent the development of a thermal boundary layer. The heat exchanging tubes 3 are so arranged that a pitch $L_1'$ over which the tube rows are spaced in the direction of the air stream A is set at 1.9 to 2.2 times the outer diameter Do' of said tubes 3, while a pitch $L_2'$ over which the tubes are spaced in each row in the direction perpendicular to the air stream A is set at 2.2 to 2.5 times the outer diameter Do' of said tubes 3. The tubes 3 extend through the plate fin 1 in close contact with inner surfaces of the fin collars 2. The above heat exchanging tubes 3 have a U-shape, with opposite ends thereof being connected by bends (not particularly shown). In FIG. 6, numerals 4*a* and 4*b* represent dead air regions formed at slip stream sides of the heat exchanging tubes 3. In the known construction as described above, however, an optimum tube arrangement for maximizing the overall heat transfer coefficient at the air side, based on the same fan power standard by taking into account the flow resistance ΔP of the air stream, is not realized, thus resulting in an uneconomical design. Moreover, since the cut and raised portions 1*a* do not extend from the base plate portion in a direction perpendicular to the air stream A flowing between the tubes 3, the average heat transfer distance from front and rear portions of said tube 3 to the cut and raised portions 1*a* tends to be long, with a consequent lowering of the fin heat transfer efficiency. And, a sufficient boundary layer leading edge effect is not produced since each cut and raised portion 1*a* has a short leading edge. Furthermore, due to the leg portions of the cut and raised portions 1*a* being superposed in a direction normal to the leading edge of the plate fin la, the air stream A is not altered in direction even after passing through the cut and raised portions 1*a*, thus making it impossible to accelerate the generation of turbulent flow. Meanwhile, dead air regions 4*a* and 4*b* are relatively large, resulting in a corresponding reduction in the effective heat transfer area. Additionally, since the neighboring cut and raised portions 1*a* are of the same length, the leg portions thereof are undesirably superposed as viewed in the direction of flow of the air stream A and thus, the resistance against flow is concentrated resulting in a non-uniform flow rate distribution, whereby the effect of the cut and raised portions 1*a* cannot be fully utilized.

SUMMARY OF THE INVENTION

Accordingly, an essential object of the present invention is to provide a higher performance fin-tube type heat exchanger which produces a significant boundary layer leading edge effect, and simultaneously prevents a lowering of fin heat transfer efficiency owing to an increase in the projected area of leading edges of the cut and raised portions.

Another object of the present invention is to provide a fin-tube type heat exchanger of the above-described kind in which the dead air regions are small, and in which an effective heat transfer area is made large owing to an accelerated generation of turbulent flow directed towards slip stream sides of the heat exchanging tubes.

A further object of the present invention is to provide a fin-tube type heat exchanger of the above-described kind in which the accelerated turbulent flow generation and the boundary layer leading edge effect owing to the cut and raised portions are increased by making the air stream velocity uniform between the heat exchanging tubes and neighboring plate fins by dispersing the resistance against the flow, thereby improving a heat transfer coefficient of the exchanger to a large extent.

In accomplishing these and other objects, according to one preferred embodiment of the present invention, there is provided a fin-tube type heat exchanger which includes a large number of plate fins arranged parallel to each other at predetermined intervals for allowing an air stream to flow therebetween, and heat exchanging tubes having an outer diameter Do and extending through the plate fins at right angles thereto for allowing fluid to flow through an interior thereof. The heat exchanging tubes are set in rows spaced apart by a pitch $L_1$ in a direction parallel to an air stream as represented by $$1.2\ Do \leqq L_1 \leqq 1.8\ Do,$$

and are spaced in each of the rows by a pitch $L_2$ in a direction perpendicular to the air stream as represented by $$2.6\ Do \leqq L_2 \leqq 3.3\ Do.$$

Each of said plate fins is formed, between said heat exchanging tubes, with a plurality of cut and raised portions open to the air stream and protruding alternately in opposite directions from a base plate of said plate fin.

The leg portions of said cut and raised portions joined to said plate fin are each arranged to form an angle with respect to a line normal to the leading edge of said plate fin, and are not superposed as viewed in the direction of the air stream. The number of cut and raised portion successively increases from central portions located between the heat exchanging tubes of the plate fin in each row towards the leading and trailing edges of said plate fin.

The height h of each of the cut and raised portions is set to be approximately ½ of a pitch $P_f$ over which said plate fins are spaced parallel to each other.

Referring to FIGS. 3 and 4, the effects produced by the above arrangement according to the present invention will be described hereinbelow.

FIGS. 3 and 4 are graphs showing an evaluation of the heat transfer performance of the fin-tube type heat exchanger in which the heat exchanging tubes having an outer diameter Do extend through a large number of plate fins arranged in parallel at predetermined intervals, with the pitch between rows of the heat exchanging tubes in the direction of the air stream being represented as $L_1$, and the pitch between tubes in each row in the direction perpendicular to the air stream being denoted as $L_2$. In experiments and analysis of the exchanger in which Do, $L_1$ and $L_2$ and air flow velocity $U_F$ are set parameters, the heat transfer performance is assessed by the overall heat transfer coefficient $\alpha o$ at the air stream side based on the same fan power $\Delta PU_F$ standard (wherein $\Delta P$ represents the flow resistance of an air stream passing through the heat exchanger). FIG. 3 shows the influence of the pitch over which the rows of the heat exchanging tubes are spaced, while FIG. 4 shows the influence of the pitch over which the tubes are spaced in the rows of said tubes. As is seen from the graphs of FIGS. 3 and 4, upon an increase of the tube row pitch $L_1$ and the tube stage pitch $L_2$, although the heat transfer coefficient on the surface of the fins is improved, the fin efficiency is undesirably lowered. Meanwhile, the flow resistance $\Delta P$ of the air stream becomes larger as the tube row pitch $L_1$ and the tube stage pitch $L_2$ are decreased. Accordingly, there is a peak value for the overall heat transfer coefficient $\alpha o$ at the air side. Although the heat transfer performance becomes maximum in the relations as denoted by $L_1 = 1.3$ Do and $L_2 = 2.9$ Do, heat transfer performance sufficiently superior for actual applications may be achieved by conforming the heat exchanger to the relations represented by $$1.2\ Do \leqq L_1 \leqq 1.8\ Do \text{ and}$$

$$2.6\ Do \leqq L_2 \leqq 3.3\ Do.$$

Moreover, in the slit-fin arrangement having the construction as described above, many leg portions of the cut and raised portions are provided, with a consequent increase in the area of the leg portions projected toward the leading edge of the plate fin, while an average heat transfer distance from the front and rear sides of the heat exchanging tube is reduced for improved fin heat transfer efficiency. Furthermore, owing to the arrangement that the leg portions of the cut and raised portions joined with the plate fin form an angle with aspect to a line normal to the lead edge of the plate fin, vortexes are produced at these leg portions, whereby not only is the formation of turbulent flow accelerated, but the dead air regions at the slip stream sides of the heat exchanging tubes are reduced thereby increasing the effective heat transfer area. Moreover, since the height h of the cut and raised portions is set to be ½ of the pitch $P_f$ of the plate fins, the cut and raised portions may be uniformly distributed between the neighboring plate fins for facilitating a uniform air stream velocity. Additionally, since the adjacent leg portions of the cut and raised portions are formed so as not to be superposed as viewed in the direction of flow of the air stream, a generation of vortexes at the leg portions is facilitated without influence at the upstream side, while resistance against the flow is dispersed to make uniform the air stream velocity between the heat exchanging tubes.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
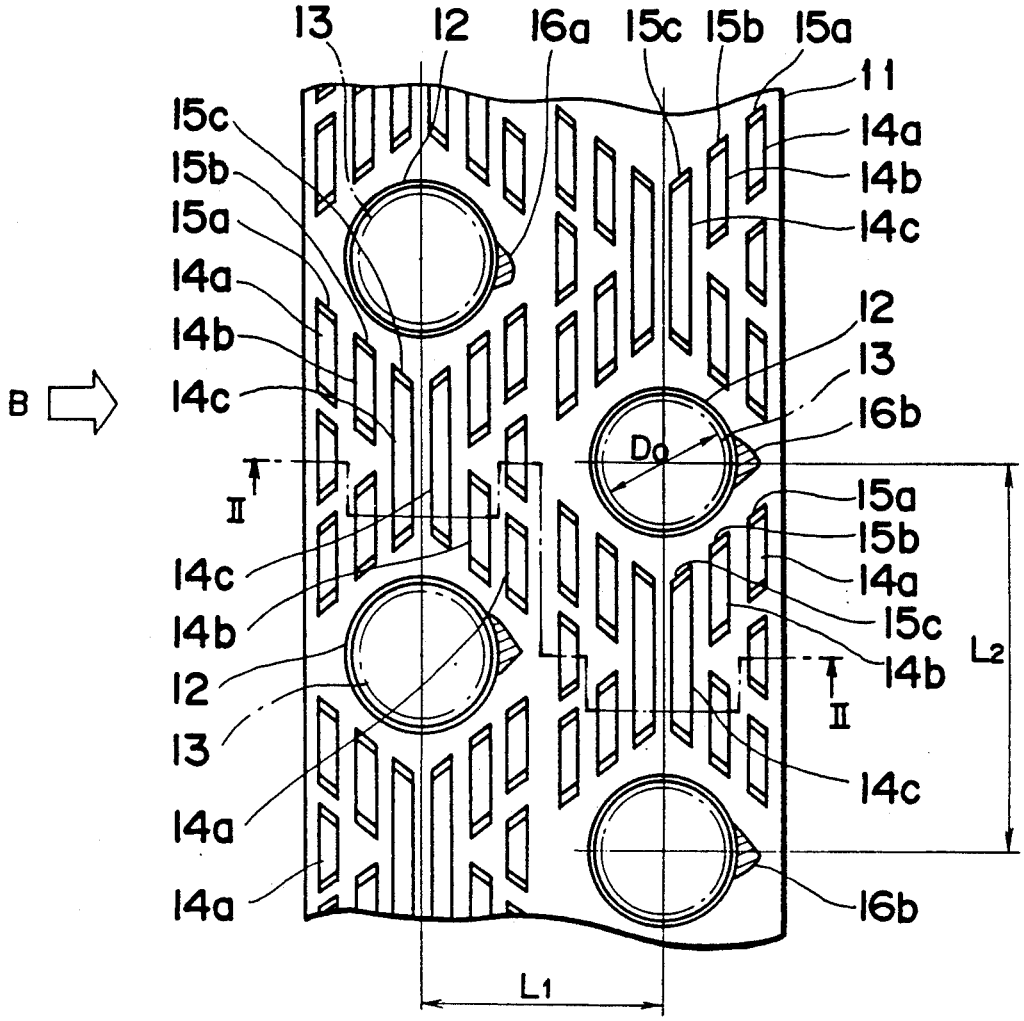
FIG. 1 is a fragmentary side elevational view of a fin-tube type heat exchanger according to one preferred embodiment of the present invention.

Before the description of the present invention proceeds, it is to be noted that like parts are designated by like reference numerals throughout the accompanying drawings.

Figure 2:
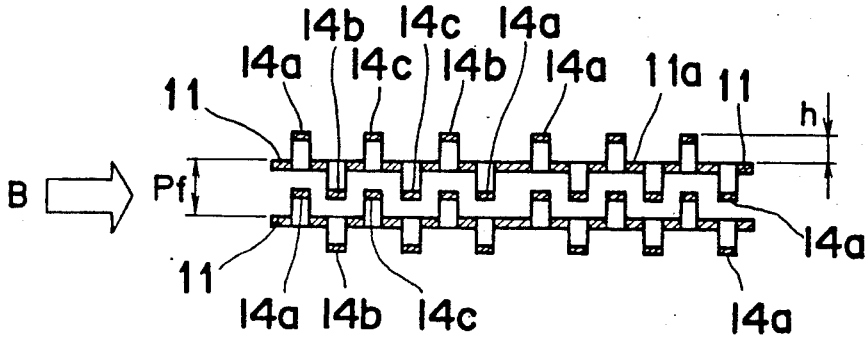
FIG. 2 is a cross-sectional view taken along the line II—II in FIG. 1, FIGS. 3 and 4 are graphs of characteristics of the fin-tube type heat exchanger according to the present invention (already referred to)
Figure 3:
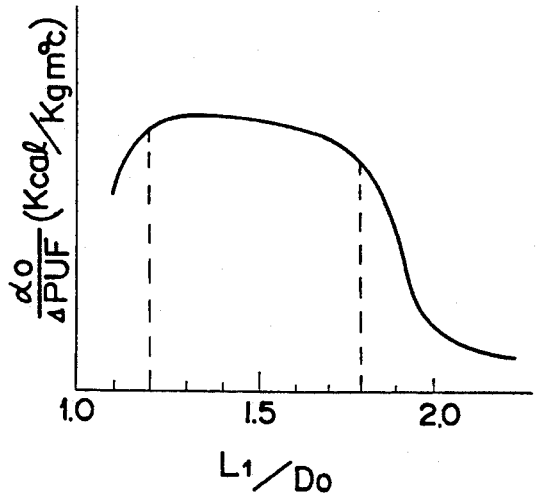
Figure 4:
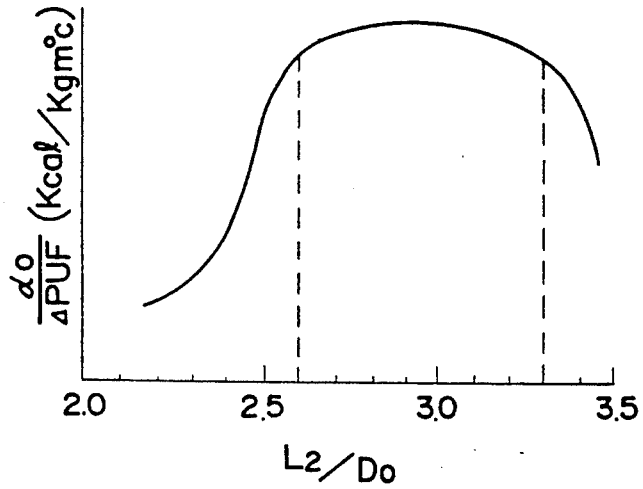
Figure 5:
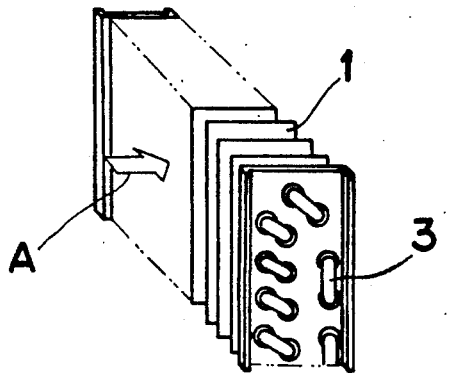
Fig. 5 PRIOR ART
FIG. 5 is a fragmentary perspective view of a conventional fin-tube type heat exchanger (already referred to)
Figure 6:
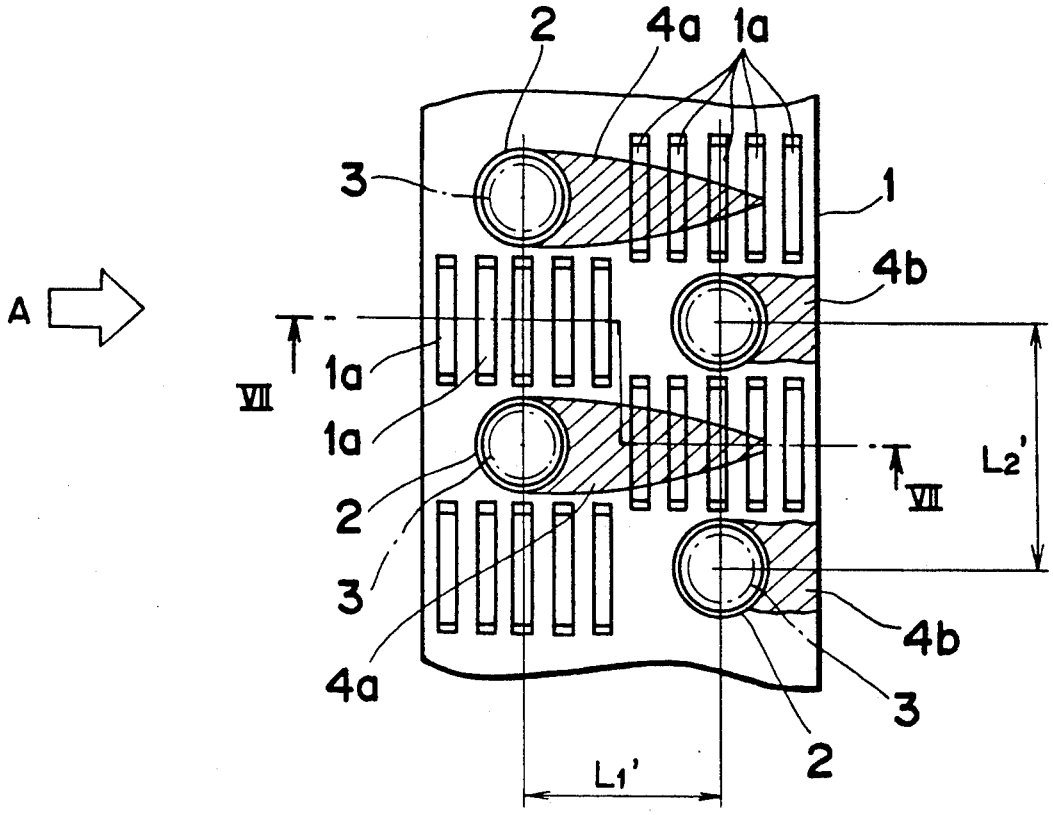
Fig. 6 PRIOR ART
FIG. 6 is a fragmentary side elevational view of the conventional fin-tube type heat exchanger.
Figure 7:
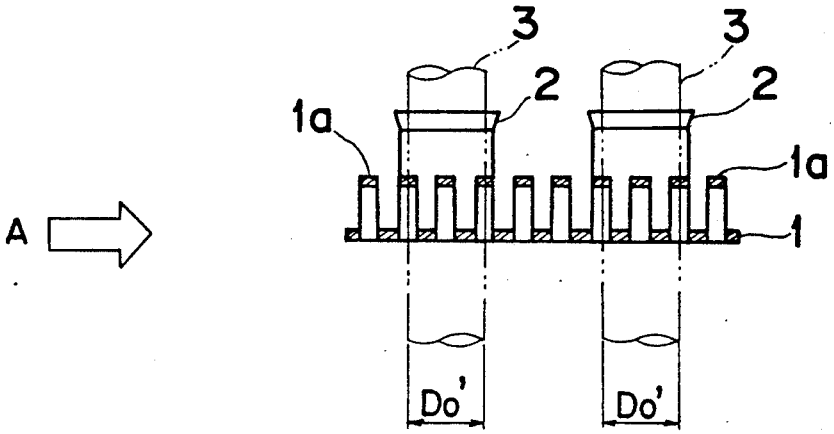
Fig. 7 PRIOR ART
FIG. 7 is a cross-sectional view taken along line VII—VII in FIG. 6.

Referring now to the drawings, there is shown in FIGS. 1 and 2, a fin-tube type heat exchanger according to one preferred embodiment of the present invention, which includes a large number of plate fins 11 arranged in a parallel relation to each other at predetermined intervals for allowing air to flow therebetween, each having fin collars 12 extending outwardly therefrom at equal intervals, and heat transfer or heat exchanging tubes 13 having an outer diameter Do and extending through the fin collars 12 of the plate fins 11 in a direction at right angles to said plate fins for causing a fluid to flow through an interior of the heat exchanging tubes 13. The heat exchanging tubes 13 are set in rows spaced apart by a pitch $L_1$ in a direction parallel to an air stream B as represented by $$1.2\ Do \leqq L_1 \leqq 1.8\ Do,$$

and are spaced in each of the rows, in a direction perpendicular to the air stream B, by a pitch $L_2$ represented by $2.6\ Do \leqq L_2 \leqq 3.3\ Do.$ Each of the plate fins 11 is formed, between the heat exchanging tubes 13, with a plurality of cut and raised portions 14*a*, 14*b* and 14*c* open to the air stream B and protruding alternately in opposite direction from a base plate 11*a* of said plate fin 11.

The leg portions 15*a*, 15*b* and 15*c* of the cut and raised portions 14*a*, 14*b* and 14*c* joined to the base plate 11*a* are each arranged to form an angle with a leading edge of said plate fin, and successive leg portions are not superposed as viewed in the direction of the air stream B. Further, the number of cut and raised portions increase from central portions of the base plate 11*a* between the heat exchanging tubes 13 in each row of the plate fin 11 towards the leading and trailing edges of said plate fin.

A height h of each of the cut and raised portion 14*a*, 14*b* and 14*c* is set to be approximately ½ of the pitch $P_f$ over which said plate fins 11 are arranged in parallel to each other. Dead air regions 16*a* and 16*b* to be produced at the slip stream sides of the heat exchanging tubes 13 are shown by numerals 16*a* and 16*b* in FIG. 1.

The effects produced by the fin-tube type heat exchanger according to the present invention will be explained hereinafter.

In the first place, since the tube row pitch $L_1$ in the direction of the air stream B is set in the relation as represented by $1.2\ Do \leqq L_1 \leqq 1.8\ Do$ and the tube stage pitch $L_2$ in the direction perpendicular to the air stream B is set in the relation as denoted by $2.6\ Do \leqq L_2 \leqq 3.3\ Do,$ the air side heat transfer performance is improved. Meanwhile, the cut and raised portion open to the air stream B are provided so as to increase in number, such as from one 14*c*, two 14*b*, three 14*c*, and so forth from the central portions between the heat exchanging tubes 13 in each row towards the edges of said plate fin 11, and also, to protrude alternately in opposite or upward and downward directions with respect to the base plate 11*a* of said plate fin 11. Thus, the leg portions 15*a* to 15*c* of the cut and raised portions 14*a* to 14*c* provide a longer projected area at the leading edge of the plate fin 11, while the average heat transfer distance from the front and rear portions of the heat exchanging tube 13 to the leg portions is also shortened resulting in an improved fin heat transfer efficiency.

Moreover, since the leg portions 15*a* to 15*c* of the cut and raised portions 14*a* to 14*c* joined to said plate fin 11 are each arranged to form an angle with respect to a line normal to the leading edge of said plate fin, vortexes are produced at these leg portions 15*a* to 15*c* for facilitating the generation of turbulent flow. And, owing to the fact that the air stream B flows into the slip stream side of the heat exchanging tube 13, dead air regions 16*a* and 16*b* may be decreased thereby increasing the effective heat transfer area.

Furthermore, since the height h of each of the cut and raised portions 14*a* to 14*c* is about ½ the pitch $P_f$ between the plate fins 11 arranged in parallel, such cut and raised portions 14*a* to 14*c* are evenly disposed between the neighboring plate fins 11, whereby the velocity of the air stream B becomes uniform and the amount of air passing through the cut and raised portions 14*a* to 14*c* is increased to improve the boundary layer leading edge effect and the turbulent flow acceleration effect. Additionally, since the leg portions 15*a* to 15*c* of each group of the cut and raised portions 14*a* to 14*c* are formed so as not to be superposed in the direction of the air stream B, the generation of vortexes at the leg portions 15*a* to 15*c* is facilitated without being influenced by the upstream flow. Still further, owing to a dispersion in the resistance against the flow, the velocity of the air stream B becomes uniform between the heat exchanging tubes 13 and thus, the amount of air passing through the cut and raised portions is increased for improving the effects produced by cut and raised portions in a fin-type heat exchanger.

By the foregoing structure according to the fin-tube type heat exchanger of the present invention, it becomes possible to simultaneously derive various effects such as an optimum heat exchange effect, a boundary layer leading edge effect, an improved fin efficiency, the acceleration of turbulent flow, a reduction in dead air regions, and the production of a uniform air stream velocity, etc., with a marked improvement of the heat transfer function of the heat exchanger, thereby realizing a compact high efficiency heat exchanger. Moreover, since the cut and raised portions alternately protrude in opposite directions on the plate fin, with the base plate portion of said plate fin therebetween, the strength of the plate fin itself is relatively high.

As is clear from the foregoing description, the fin-tube type heat exchanger according to the present invention includes the large number of plate fins arranged in a parallel relation to each other at predetermined intervals for allowing an air stream to flow therebetween, and the heat exchanging tubes having an outer diameter Do and extending through the plate fins in a direction at right angles thereto for allowing fluid to flow through the interior thereof. The heat exchanging tubes are set in rows spaced apart by a pitch $L_1$ in the direction parallel to the air stream as represented by $1.2\ Do \leqq L_1 \leqq 1.8\ Do,$ and are spaced in each of the rows by a pitch $L_2$ in the direction perpendicular to the air stream as represented by $2.6\ Do \leqq L_2 3.3\ Do.$ Each of the plate fins is formed, between said heat exchanging tubes, with the plurality of cut and raised portions open to the air stream and protruding alternately in opposite directions from the base plate of said plate fin. The leg portions of each group of the cut and raised portions joined to the plate fin are each arranged to form an angle with respect to a line normal to the leading edge of said plate fin, and are not superposed as viewed in the direction of the air stream. The number of cut and raised portion increase from central portions of the plate fin located between the heat exchanging tubes in each row thereof towards the leading and trailing edges of the plate fin. The height h of each of the cut and raised portions is set to be approximately ½ of the pitch $P_f$ over which said plate fins are spaced parallel to each other.

Since the fin-tube type heat exchanger according to the present invention is arranged as described so far, the following effects may be obtained.

By the optimum heat exchanging tube arrangement, the air side heat transfer performance may be most improved by the same fan power standard. Since many leg portions of the cut and raised portions are provided in which the projected area of leading edges thereof is increased, the boundary layer leading edge effect is improved while the fin efficiency is also improved by a reduction in the average heat transfer distance between the leg portions and heat exchange tubes. By the generation of vortexes at the leg portions of the cut and raised portions, the formation of turbulent flow is facilitated, and simultaneously, through a reduction in the dead air regions, the effective heat transfer area may be increased. Moreover, the velocity of the air stream can be made uniform between the neighboring plate fins and the heat exchanging tubes, and therefore the boundary layer leading edge effect and the turbulent flow accelerating effect produced by the cut and raised portions ca be increased. Furthermore, the toughness of the plate fin itself remains high.

By the effects described above, the heat exchanging performance of the heat exchanger is remarkably improved, and thus a compact high performance fin-tube type heat exchanger has been realized.

Although the present invention has been fully described by way of example with reference to the accompanying drawings, it is to be noted here that various changes and modifications will be apparent to those skilled in the art. Therefore, unless such changes and modifications otherwise depart from the scope of the present invention, they should be construed as included therein.

What is claimed is:

1. A fin-tube type heat exchanger comprising a plurality of plate fins defining leading and trailing edges of the heat exchanger and arranged in parallel to each other at predetermined intervals for allowing air to flow as a stream therebetween in a direction extending from said leading edge to said trailing edge, and heat exchanging tubes having an outer diameter Do and extending through said plate fins in a direction at right angles thereto for allowing fluid to flow through an interior of said heat exchanging tubes, said heat exchanging tubes being disposed in a plurality of rows spaced apart by a tube row pitch $L_1$ measured in the flow direction between the centers of the tubes in adjacent ones at said rows, and which tube row pitch $L_1$ satisfies the equation $$1.2\ D \leqq L_1 \leqq 1.8\ Do,$$

said heat exchanging tubes being spaced from each other in each of said rows by a tube stage pitch $L_2$ measured between the centers of the tubes in a direction perpendicular to the flow direction, and which tube stage pitch $L_2$ satisfies the equation $$2.6\ Do \leqq L_2 \leqq 3.3\ Do,$$

and said heat exchanging tubes in each of said rows being offset from the heat exchanging tubes in the rows adjacent thereto with respect to the flow direction;

each of said plate fins having a base plate, a respective group of cut and raised portions located in each central portion of the base plate that is defined between each adjacent pair of said heat exchanging tubes in said rows thereof, and leg portions integral with and protruding from said base plate and joining said cut and raised portions to said base plate, said cut and raised portions and said leg portions defining spaces in said base plate open to a space between adjacent ones of said plate fins arranged in parallel;

the cut and raised portions being arranged in a plurality of rows, spaced apart in the flow direction, in each said group thereof, two of said leg portions joining the cut and raised portions to the base plate in each of said rows of said group of cut and raised portions being disposed symmetrically to one another with respect to a first plane extending in the flow direction midway between the adjacent pair of said heat exchanging tubes;

the two leg portions, which join to said base plate said cut and raised portions in first respective rows thereof that are located between the leading edge of the heat exchanger and a second plane passing through the center of said adjacent pair of said heat exchangers, being inclined with respect to said flow direction toward said first plane, and the interval between the two leg portions decreasing in said first respective rows in the flow direction whereby an air-conducting space defined between the two leg portions in said first respective rows tapers in the flow direction toward said second plane; and each of said two leg portions, which join to said base plate said cut and raised portions in second respective rows thereof that are located between said second plane and the trailing edge of said heat exchanger, being inclined with respect to said flow direction away from said first plane, and the interval between the two leg portions increasing in said second respective rows in the flow direction whereby an air-conducting space defined between said two leg portions in said respective rows widens in the flow direction about said second plane.

2. A fin-tube type heat exchanger as claimed in claim 1, wherein said heat exchanging tubes are cylindrical, and each of said two leg portions is inclined so as to lie in a plane parallel to a tangent of the cylindrical heat exchanging tube closest thereto.

3. A fin-tube type heat exchanger as claimed in claim 1, wherein a height h of the cut and raised portions from the base plate to which the cut and raised portions are joined is approximately one-half of a pitch $P_f$ corresponding to the interval over which said plate fins are arranged parallel to each other.

4. A fin-tube type heat exchanger as claimed in claim 1, wherein non of said two leg portions in each of said first and said second rows are superposed as taken in the flow direction.

5. A fin-tube type heat exchanger comprising a plurality of plate fins defining leading and trailing edges of the heat exchanger and arranged in parallel to each other at predetermined intervals for allowing air to flow as a stream therebetween in a direction extending from said leading edge to said trailing edge, and heat exchanging tubes having an outer diameter Do and extending through said plate fins in a direction at right angles thereto for allowing fluid to flow through an interior of said heat exchanging tubes, said heat exchanging tubes being disposed in a plurality of rows spaced apart by a tube row pitch $L_1$ measured in the flow direction between the centers of the tubes in adjacent ones at said rows, and which tube row pitch $L_1$ satisfies the equation $$1.2\ Do \leqq L_1 \leqq 1.8\ Do,$$

said heat exchanging tubes being spaced from each other in each of said rows by a tube stage pitch $L_2$ measured between the centers of the tubes in a direction perpendicular to the flow direction, and which tube stage pitch $L_2$ satisfies the equation $$2.6\ Do \leqq L_2 \leqq 3.3\ Do,$$

and said heat exchanging tubes in each of said rows being offset from the heat exchanging tubes in the rows adjacent thereto with respect to the flow direction.

6. A fin-tube type heat exchanger as claimed in claim 5, wherein each of said plate fins has a base plate, a respective group of cut and raised portions located in each central portion of the base plate that is defined between each adjacent pair of said heat exchanging tubes in said rows thereof, and leg portions integral with and protruding from said base plate and joining said cut and raised portions to said base plate, said cut and raised portions and said leg portions defining spaces in said base plate open to a space between adjacent ones of said plate fins arranged in parallel, and said heat exchanging tubes are cylindrical, said leg portions being inclined so as to each lie in a plane parallel to a tangent of the cylindrical heat exchanging tube closest thereto.

7. A fin-tube type heat exchanger as claimed in claim 6, wherein the cut and raised portions are arranged in a plurality of rows, spaced apart in the flow direction, in each said group, two of said leg portions adjoining the cut and raised portions to the base plate in each of said rows of said group of cut and raised portions being disposed symmetrically to one another with respect to a first plane extending in a flow direction midway between the adjacent pair of said heat exchanging tubes.

8. A fin-tube type heat exchanger as claimed in claim 5, wherein a height h of the cut and raised portions from the base plate to which the cut and raised portions are joined is approximately one-half of a pitch $P_f$ corresponding to the interval over which said plate fins are arranged parallel to each other.

9. A fin-tube type heat exchanger as claimed in claim 5, wherein none of said two leg portions in each of said first and second rows are superposed as taken in the flow direction.

* * * * *